United States Patent [19]

Kanai et al.

[11] Patent Number: 4,540,971

[45] Date of Patent: Sep. 10, 1985

[54] METAL OXIDE VARISTOR MADE BY A CO-PRECIPATION PROCESS AND FREEZE-DRIED

[75] Inventors: Hideyuki Kanai, Kawasaki; Takashi Takahashi, Tokyo; Motomasa Imai, Inagi; Osamu Furukawa, Sagamihara; Hiroshi Endo, Yokohama; Osamu Hirao, Tokyo; Masaru Hayashi, Yokohama, all of Japan

[73] Assignee: Tokyo Shibaura Denki Kabushiki Kaisha, Kawasaki, Japan

[21] Appl. No.: 506,768

[22] Filed: Jun. 22, 1983

[30] Foreign Application Priority Data

Jun. 25, 1982 [JP] Japan ..... 57-108309

[51] Int. Cl.[3] ..... H01C 7/10; H01B 1/08

[52] U.S. Cl. ..... 338/21; 29/610 R; 264/61; 252/518

[58] Field of Search ..... 338/20, 21; 252/518-521; 264/61, 63, 65; 29/610 R

[56] References Cited

U.S. PATENT DOCUMENTS

| | | | |
|---|---|---|---|
| 4,097,392 | 6/1978 | Goldman et al. | 264/63 X |
| 4,142,996 | 3/1979 | Wong et al. | 252/521 X |
| 4,318,995 | 3/1982 | Rhodes et al. | 252/520 X |
| 4,372,865 | 2/1983 | Yu et al. | 264/65 X |

FOREIGN PATENT DOCUMENTS

| | | | |
|---|---|---|---|
| 2526137 | 6/1975 | Fed. Rep. of Germany | 338/21 |
| 2910841 | 9/1980 | Fed. Rep. of Germany . | |
| 49-118661 | 11/1974 | Japan | 252/518 |
| 54-80595 | 6/1979 | Japan | 338/21 |
| 56-101711 | 8/1981 | Japan | 338/21 |

OTHER PUBLICATIONS

Sato, IEEE Transactions of Magnetics, Dec. 1970.
Thomson, Jr., Am. Ceram. Soc. Bull., 53,421, 1974.
Tasaki, Bulletin of the Ceramic Society of Japan, No. 11, 1981.

*Primary Examiner*—Roy N. Envall, Jr.
*Assistant Examiner*—C. N. Sears
*Attorney, Agent, or Firm*—Schwartz, Jeffery, Schwaab, Mack, Blumenthal & Evans

[57] ABSTRACT

A metal oxide varistor is disclosed which a component of grain bodies comprised of zinc oxide and a component of grain boundary layers comprised of another metallic oxide, containing metal other than zinc wherein at least a portion of these starting materials comprised a fine particle powder prepared by a co-precipitatin method.

The metal oxide varistor of the present invention is excellent in varistor characteristics such as non-linearity to voltage, life performances and capability of energy dissipation, is small in a scatter of the above characteristics between manufacture lots or within each lot at the time of manufacture, and has a good quality stability. Unexpected results are obtained when the co-precipitated fine particles are subjected to a refrigeration-dehydration type process.

12 Claims, 2 Drawing Figures

METAL OXIDE VARISTOR MADE BY A CO-PRECIPATION PROCESS AND FREEZE-DRIED

SUMMARY OF THE INVENTION

Figure 1:
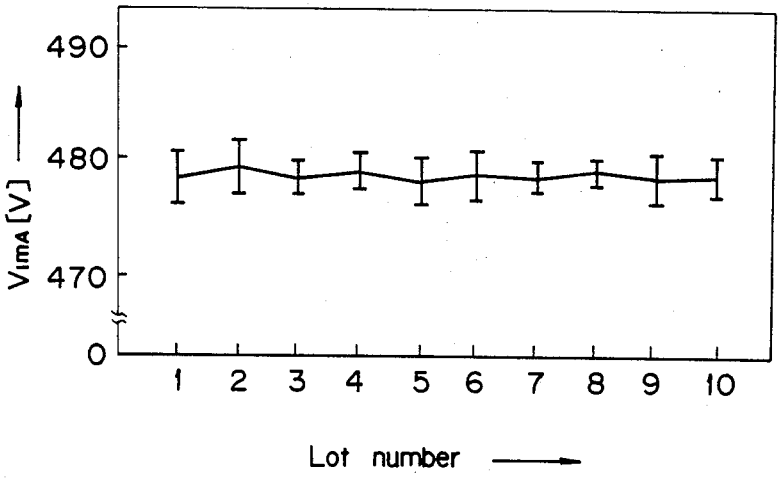

This invention relates to an oxide varistor, particularly to a zinc oxide (ZnO) varistor which is excellent in varistor characteristics such as non-linearity to voltage, life performances and capability of energy dissipation, shows little variation in the above characteristics between manufacture lots or within each lot at the time of manufacture, and has a good quality stability, and particularly, it relates to an improvement in its materials.

As one of circuit elements made from a semiconductor, there is a varistor, and a varistor made from a zinc oxide sintered body is typically known.

This type of varistor has non-linear voltage-current characteristics, and its resistance decreases abruptly with the raise of the applied voltage so that current flowing therethrough increases remarkably. Therefore, such a varistor has been employed practically and widely for absorption of an extraordinarily high voltage or for stabilization of voltage.

Such a zinc oxide varistor as mentioned above is usually manufactured in the following procedure: Namely, first, a powder of zinc oxide which is a main component is blended, in a predetermined proportion, with a fine powder of a metallic oxide such as bismuth oxide ($Bi_2O_3$), antimony oxide ($Sb_2O_3$), cobalt oxide (CoO), manganese oxide (MnO) or the like which is an additive component, and these powders are mixed and ground with the aid of a medium (e.g., zirconia balls) in a suitable mixing and grinding machine and are then formed, using a suitable binder, into grains each having a predetermined grain diameter. Afterward, a mold is charged with the above grainy powder, and pressure molding is carried out to prepare powder compacts (e.g., pellets). The obtained powder compacts are then sintered at a temperature within the range of 1100° to 1350° C. (See, for example, Japanese Journal of Applied Physics, Vol. 10, No. 6, June (1976), p. 736 "Nonohmic Properties of Zinc Oxide Ceramics").

With regard to the obtained sintered bodies, the zinc oxide which is the main component usually constitutes the component of relatively large grain bodies of as much as several micrometers to several tens of micrometers, and the metallic oxide which is the additive component constitutes the component of thin grain boundary layers which are interposed among cantact surfaces of the zinc oxide grain bodies in the state of wrapping them.

In the zinc oxide varistor which is the sintered body having such a fine structure, a systematic uniformity of the respective components is one important factor for stabilization and improvement of the above-mentioned various characteristics.

In a conventional manufacturing method, however, it is difficult to give a uniform grain diameter to the zinc oxide powder and the additive component powder which are employed as materials, and since an amount of the additive component is generally extremely small as compared with that of the zinc oxide powder, the mixing of the zinc oxide powder and the additive component tends to be nonuniform, so that there occurs the problem that it is very hard to interpose the grain boundary component layers each having a uniform thickness among the zinc oxide grain bodies.

Such a matter not only allows the variability of quality properties to increase between manufacture lots or within one lot of products and brings about a deterioration in their quality stability,, but also leads disadvantageously to a degradation in varistor characteristics themselves of the obtained varistor, such as non-linearity to voltage, life performances and capability of energy dissipation.

SUMMARY OF THE INVENTION

Accordingly, an object of this invention is to provide a zinc oxide varistor in which the respective components are highly fine and particularly its structure is uniform all over, with the result that excellent varistor characteristics can be obtained.

The inventors of this invention have noted the fact that the characteristics and reliability of the varistor depend greatly on the uniformity of a grain diameter of each component and the uniformity of a thickness of the grain boundary component layers in its structure. From this viewpoint, they have conducted intensive research on a preparation of starting powder materials which permit the acquisition of such requirements as mentioned above, and as a result it has been found that in starting powder materials prepared in a co-precipitation manner which is widely applied in a process for manufacturing a multicomponent catalyst, their grain diameter has an extremely small grain diameter and their grain diameter distribution is also uniform. Further, they have found that when the aforesaid starting powder materials are substituted for conventional discrete starting powder materials which are previously separately manufactured, the obtained varistor will improve in the varistor characteristics. And thus, the present invention has been established.

The metal oxide varistor according to this invention comprises a component of grain bodies composed of zinc oxide and a component of grain boundary layers composed of another metallic oxide, characterized in that at least a portion of these starting materials is a fine particle powder prepared by a co-precipitation and freeze drying method.

BRIEF DESCRIPTION OF PREFERRED EMBODIMENTS

Figure 2:
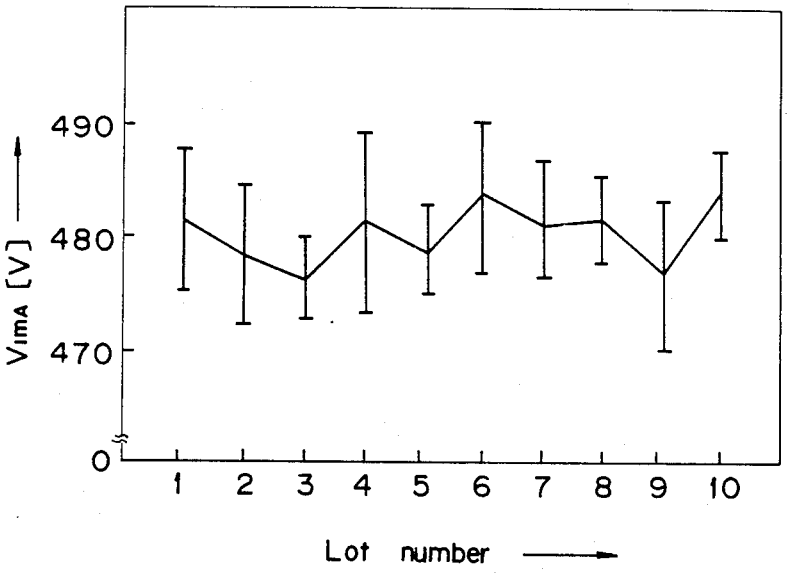

FIGS. 1 and 2 are diagrams showing scatter states between lots and within each lot of Samples 1 and 15', respectively, in the Example.

In the varistor according to this invention, the principal component of the grain bodies is zinc oxide. As a starting powder material to be used for it, a conventional material is acceptable, but a material prepared by the co-precipitation manner mentioned below is preferable.

As the component of the grain boundary layers, any conventional compounds are usable, so long as they can form layers among the grain bodies in combination with their zinc oxide component. However, preferable examples of the grain boundary material include one or more kinds of oxides of antimony (Sb), bismuth (Bi), cobalt (Co), manganese (Mn), chromium (Cr), nickel (Ni), silicon (Si), and the like, as well as spinel oxides represented by, for example, $Zn_{2.33}Sb_{0.67}O_4$. Among them, oxides of Sb, Bi and Co are more preferred. Particularly, a fine particle powder of a metallic oxide prepared by co-precipitating at least one of Sb, Bi and Co with Zn is the most preferable grain boundary layer component in view of the varistor characteristics.

Now, in the materials for the varistor according to this invention, at least a portion thereof is prepared in a co-precipitation manner.

For example, the zinc oxide powder for the component of the grain bodies may be prepared in accordance with the co-precipitation process, as follows: First of all, a salt such as $Zn(NO_3)_2$ is dissolved in a predetermined amount of water to prepare an aqueous solution including $Zn^{2+}$ at a predetermined concentration. Thereto, for example, ammonia water is added in order to adjust a pH of the whole solution to a level within the range of 6 to 10, so that $Zn(OH)_2$ precipitates. The resultant precipitate is collected by filtration, washed with water and dehydrated by means of suction, and a refrigerating dehydration is further carried out at a low temperature of, for example, −25° C. or less. Afterward, the precipitate is melted, for example, at a temperature of 20° C. or less, extraction water at this time is filtered off, and water is then removed therefrom with an alcohol.

The compound $Zn(OH)_2$ thus obtained in this way is in the state of usually amorphous powdered grains each having an extremely small grain diameter (0.5 μm or less).

Also, the component of the grain boundary layers can be prepared in like manner. In this case, procedure is the same as mentioned above except that a salt of a metal of the grain boundary component is used.

With regard to each starting powder material used in this invention, a powder (still in the form of a hydroxide) which has undergone the dehydration treatment as mentioned above may be utilized as it is; alternatively this powder may be subjected to a further dehydration at a temperature within the range of 250° to 300° C. in order to change into an oxide, and the resultant oxide may be utilized.

In this invention, irrespective of the grain body component (ZnO) and the grain boundary layer component, at least a portion of the respective components is prepared by the above-mentioned co-precipitation method. Particularly, with regard to the grain boundary layer component, it is preferred that at least a portion thereof is prepared in the co-precipitation manner.

In this case, the respective components may be separately prepared as discrete precipitates and blended in a predetermined proportion, but it is preferable that the starting powder materials are prepared by precipitating simultaneously two or more kinds of required components. Further, it is more preferable that all the starting powder materials for a metal oxide varistor within the present invention be prepared by the above-described co-precipitation method.

The co-precipitation of the respective components is preferably accomplished by preparing a aqueous solution including metals for the respective metallic oxides in the varistor to be made, at an ion concentration corresponding to an amount of each metal, and then co-precipitating the respective components at one time. The reason why this way is preferred is that the respective precipitates can constitute a co-precipitate in which they coexist in about the same proportion as a metallic composition of the metallic oxides in the varistor to be manufactured. In other words, according to the above-mentioned manner, the formed co-precipitate contains the respective components in a uniform mixing state, so that, when sintered, there can be obtained the varistor having a system structure in which the respective components are uniformly dispersed.

In the varistor according to this invention, the metallic oxide prepared by the co-precipitation process is contained in the whole starting metallic oxides preferably in an amount of 0.4 to 100% by weight, more preferably is an amount of 0.4 to 50% by weight.

This invention will be described further in detail in accordance with the Example as follows:

EXAMPLE

A. Preparation of samples

By the use of $Zn(NO_3)_2$ for Zn, $SbCl_3$ for Sb, $Bi(NO_3)_3$ for Bi, $Co(NO_3)_2$ for Co, $Mn(NO_3)_2$ for Mn, $Cr(NO_3)_3$ for Cr, $Ni(NO_3)_2$ for Ni and $Na_4SiO_4$ for Si, the respective aqueous solutions having predetermined concentrations were prepared. The concentrations of the respective metallic ions were regulated in terms of corresponding metallic oxides, at blending ratios (mole %) listed in Table 1 in the varistor to be manufactured. Asterisks in Table 1 are affixed to starting powder materials prepared in the co-precipitation manner according to this invention.

An aqueous ammonium bicarbonate solution having a concentration of 4N and ammonia water having the same concentration were added to each aqueous solution while stirring in order to adjust its pH to 7–8, so that a precipitate having a grain diameter of less than 0.5 μm was obtained. Then, each precipitate was collected by filtration, washed with water and dehydrated by means of suction. The resultant cake was subjected to a refrigerating dehydration at a temperature of −25° C. or less, and the refrigerated product was melted at 20° C. The extraction water at this time was filtered off and water was finally removed therefrom with ethyl alcohol. At the last step, each resultant product was heated at 300° C. to obtain a starting powder material.

Afterward, the respective starting powder materials were blended in each ratio listed in Table 1 and mixed sufficiently in, for example, a pot made from a nylon resin. After drying of each mixed powder, a suitable amount of PVA was added thereto in order to form its grains.

A mold having a predetermined size and shape was charged with each above formed grainy powder, and pressure molding was then carried out. The resultant pellets were sintered at 1300° C. for 2 hours in order to form a disc a 20 mm in diameter of 2 mm in thickness.

Flame spray electrodes of aluminum were fixed on both the surfaces of each disc to provide samples for measurement of characteristics.

Incidentally, in Table 1 below, compounds having no asterisks (*) are conventional starting powder materials.

Further, for comparison, an apostrophe mark is affixed to each sample comprising material which is similar in a blending ratio to the corresponding sample without any mark but which was not prepared by the co-precipitation method.

TABLE 1

| Sample number | Component (Unit: mole %) | | | | | | | |
|---|---|---|---|---|---|---|---|---|
| | ZnO | $Bi_2O_3$ | $Co_2O_3$ | MnO | $Sb_2O_3$ | NiO | $Cr_2O_3$ | $SiO_2$ |
| Example | | | | | | | | |
| 1 | 94.5* | 0.75* | 0.75 | 0.5* | 1.0 | 1.0* | 0.5* | 1.0 |
| 2 | 94.5* | 0.75 | 0.75 | 0.5* | 1.0 | 1.0 | 0.5* | 1.0 |
| 3 | 94.5* | 0.75* | 0.75* | 0.5 | 1.0* | 1.0 | 0.5 | 1.0* |
| 4 | 94.5* | 0.75* | 0.75* | 0.5* | 1.0* | 1.0* | 0.5* | 1.0* |
| 5 | 95.75* | 0.5 | 0.5* | 0.5 | 1.0* | 1.0 | 0.25* | 0.5 |
| 6 | 95.5* | 0.5* | 0.5* | 0.75* | 0.5 | 1.0 | 0.25 | 0.5 |
| 7 | 95.75* | 0.5 | 0.5* | 0.75* | 0.5 | 0.5* | 0.5* | 1.0* |
| 8 | 95.0 | 0.5* | 0.5* | 0.5* | 1.0 | 1.0* | 0.5* | 1.0* |
| 9 | 94.5* | 0.75 | 0.75 | 0.5 | 1.0* | 1.0 | 0.5 | 1.0 |
| 10 | 94.5* | 0.75* | 0.75 | 0.5 | 1.0* | 1.0 | 0.5 | 1.0 |
| 11 | 94.5* | 0.75* | 0.75* | 0.5 | 1.0* | 1.0 | 0.5 | 1.0 |
| 12 | 94.5* | 0.75* | 0.75* | 0.5* | 1.0* | 1.0 | 0.5 | 1.0 |
| 13 | 96.0* | 0.5 | 0.5 | 0.5 | 1.0* | 0.5* | 0.5 | 0.5 |
| 14 | 95.75* | 0.5* | 0.75 | 0.75* | 0.75* | 0.5 | 0.5* | 0.5 |
| 15 | 96.25* | 0.5 | 0.5 | 0.75 | 0.75* | 0.5 | 0.25 | 0.5 |
| 16 | 96.0* | 0.5* | 0.5* | 0.5 | 0.75* | 1.0 | 0.25* | 0.5* |
| 17 | 95.75 | 0.5* | 0.5 | 0.5 | 1.0 | 0.5 | 0.5* | 1.0 |
| 18 | 95.75 | 0.5* | 0.5* | 0.5* | 1.0* | 0.5* | 0.5* | 1.0* |
| 19 | 95.75 | 0.5* | 0.5* | 0.5 | 1.0* | 0.5 | 0.5* | 1.0 |
| 20 | 95.75 | 0.5* | 0.5 | 0.5* | 1.0 | 0.5 | 0.5* | 1.0 |
| 21 | 96.0 | 0.5* | 0.5* | 0.5 | 0.5* | 1.0* | 0.25* | 1.0 |
| 22 | 96.0 | 0.75* | 0.5* | 0.75* | 0.5* | 1.0 | 0.25* | 0.5 |
| 23 | 96.25 | 0.5* | 0.5 | 0.5* | 1.0* | 0.5 | 0.5 | 0.5 |
| 24 | 96.0 | 0.5* | 0.5* | 0.75* | 0.5* | 1.0* | 0.5 | 0.5 |
| 25 | 95.0* | 0.5* | 0.5 | 0.5* | 1.0 | 1.0* | 0.5* | 1.0 |
| 26 | 95.0* | 0.5* | 0.5 | 0.5 | 1.0* | 1.0 | 0.5 | 1.0 |
| 27 | 95.0* | 0.5* | 0.5* | 0.5* | 1.0* | 1.0* | 0.5* | 1.0* |
| 28 | 95.0* | 0.5 | 0.75* | 0.75 | 1.0* | 1.0 | 0.5 | 0.5 |
| 29 | 96.0 | 0.5* | 0.5 | 0.5* | 0.5 | 0.5 | 1.0* | 0.5 |
| 30 | 96.5 | 0.5* | 0.5* | 0.5* | 1.0 | 1.0 | — | — |
| 31 | 96.5 | 0.5* | 0.5 | 0.5* | 1.0 | 1.0* | — | — |
| 32 | 96.5 | 0.5* | 0.5 | 0.5* | 1.0* | 1.0 | — | — |
| 33 | 96.5* | 0.5* | 0.5* | 0.5* | 1.0* | 1.0* | — | — |
| 34 | 96.0* | 0.5 | 0.75 | 0.5 | 1.25* | 1.0 | — | — |
| 35 | 96.0* | 0.5* | 0.75 | 0.5* | 1.25 | 1.0 | — | — |
| 36 | 96.0* | 0.5* | 0.75 | 0.5* | 1.25* | 1.0 | — | — |
| 37 | 96.0* | 0.5* | 0.75* | 0.5* | 1.25* | 1.0* | — | — |
| Comparative example | | | | | | | | |
| 1' | 94.5 | 0.75 | 0.75 | 0.5 | 1.0 | 1.0 | 0.5 | 1.0 |
| 2' | 95.75 | 0.5 | 0.5 | 0.5 | 1.0 | 1.0 | 0.25 | 0.5 |
| 3' | 95.5 | 0.5 | 0.5 | 0.75 | 0.5 | 1.0 | 0.25 | 0.5 |
| 4' | 95.75 | 0.5 | 0.5 | 0.75 | 0.5 | 0.5 | 0.5 | 1.0 |
| 5' | 95.0 | 0.5 | 0.5 | 0.5 | 1.0 | 1.0 | 0.5 | 1.0 |
| 6' | 96.0 | 0.5 | 0.5 | 0.5 | 1.0 | 0.5 | 0.5 | 0.5 |
| 7' | 95.75 | 0.5 | 0.75 | 0.75 | 0.75 | 0.5 | 0.5 | 0.5 |
| 8' | 96.25 | 0.5 | 0.5 | 0.75 | 0.75 | 0.5 | 0.25 | 0.5 |
| 9' | 96.0 | 0.5 | 0.5 | 0.5 | 0.75 | 1.0 | 0.25 | 0.5 |
| 10' | 96.0 | 0.5 | 0.5 | 0.5 | 0.5 | 1.0 | 0.25 | 1.0 |
| 11' | 96.0 | 0.75 | 0.5 | 0.75 | 0.5 | 1.0 | 0.25 | 0.5 |
| 12' | 96.25 | 0.5 | 0.5 | 0.5 | 1.0 | 0.5 | 0.5 | 0.5 |
| 13' | 96.0 | 0.5 | 0.5 | 0.75 | 0.5 | 1.0 | 0.5 | 0.5 |
| 14' | 95.0 | 0.5 | 0.75 | 0.75 | 1.0 | 1.0 | 0.5 | 0.5 |
| 15' | 96.0 | 0.5 | 0.5 | 0.5 | 0.5 | 0.5 | 1.0 | 0.5 |
| 16' | 95.75 | 0.5 | 0.5 | 0.5 | 1.0 | 0.5 | 0.5 | 1.0 |
| 17' | 96.5 | 0.5 | 0.5 | 0.5 | 1.0 | 1.0 | — | — |
| 18' | 96.0 | 0.5 | 0.75 | 0.5 | 1.25 | 1.0 | — | — |

B. Measurement of characteristics (1) Life performances

Each sample was placed in a thermostatic chamber, and measurements were made for initial voltages $V_{1mA}$ and $V_{10\mu A}$ at the time when currents of 1 mA and 10 μA were allowed to flow therethrough, and were further made for voltages $(V_{1mA})_{200}$ and $(V_{10\mu A})_{200}$ at the time when voltages as much as 95% of the initial voltages were applied thereto for a period of 200 hours. Rates of change $[(V_{1mA})_{200}-V_{1mA}]/V_{1mA}$ and $[(V_{10\mu A})_{200}-V_{10\mu A}]/V_{10\mu A}$ were then evaluated from then and showed in terms of percentage (%). This rate of change means that the less it is, the less a characteristic degradation of the sample is.

The rates of change of the respective samples are set forth in Table 2 below.

TABLE 2

| Sample number | $\frac{(V_{10\mu A})_{200}-V_{10\mu A}}{V_{10\mu A}}\times 100[\%]$ | $\frac{(V_{1mA})_{200}-V_{1mA}}{V_{1mA}}\times 100[\%]$ |
|---|---|---|
| 1 | −4.8 | −1.0 |
| 2 | −5.1 | −1.1 |
| 3 | −5.0 | −1.2 |
| 4 | −4.3 | −1.1 |
| 5 | −4.5 | −1.3 |
| 6 | −4.9 | −1.2 |
| 7 | −5.2 | −1.2 |
| 8 | −5.4 | −1.3 |
| 9 | −5.6 | −1.5 |
| 10 | −5.1 | −1.3 |
| 11 | −4.8 | −1.2 |

TABLE 2-continued

| Sample number | $\frac{(V_{10\mu A})_{200} - V_{10\mu A}}{V_{10\mu A}} \times 100[\%]$ | $\frac{(V_{1mA})_{200} - V_{1mA}}{V_{1mA}} \times 100[\%]$ |
|---|---|---|
| 12 | −4.3 | −1.2 |
| 13 | −4.8 | −1.3 |
| 14 | −5.1 | −1.5 |
| 15 | −4.7 | −1.4 |
| 16 | −4.5 | −1.2 |
| 17 | −4.9 | −1.2 |
| 18 | −5.1 | −1.1 |
| 19 | −5.3 | −1.0 |
| 20 | −4.8 | −1.0 |
| 21 | −4.3 | −1.5 |
| 22 | −4.5 | −1.6 |
| 23 | −5.2 | −1.1 |
| 24 | −5.4 | −1.2 |
| 25 | −4.2 | −1.2 |
| 26 | −4.3 | −1.3 |
| 27 | −3.5 | −1.0 |
| 28 | −4.6 | −1.1 |
| 29 | −5.1 | −1.8 |
| 30 | −4.7 | −1.3 |
| 31 | −4.6 | −1.2 |
| 32 | −4.5 | −1.2 |
| 33 | −4.3 | −1.1 |
| 34 | −4.8 | −1.3 |
| 35 | −4.7 | −1.2 |
| 36 | −4.5 | −1.1 |
| 37 | −4.2 | −1.0 |
| 1′ | −21.5 | −5.6 |
| 2′ | −24.3 | −5.1 |
| 3′ | −25.8 | −6.5 |
| 4′ | −24.9 | −5.3 |
| 5′ | −27.1 | −5.4 |
| 6′ | −25.1 | −5.2 |
| 7′ | −26.2 | −5.8 |
| 8′ | −24.7 | −4.9 |
| 9′ | −23.8 | −4.8 |
| 10′ | −28.1 | −6.2 |
| 11′ | −23.5 | −5.8 |
| 12′ | −29.1 | −5.1 |
| 13′ | −30.3 | −5.7 |
| 14′ | −27.6 | −5.6 |
| 15′ | −25.3 | −5.9 |
| 16′ | −26.2 | −5.7 |
| 17′ | −21.3 | −5.6 |
| 18′ | −21.8 | −5.4 |

(2) Non-linearity and capability of energy dissipation

A measurement was made for a voltage $V_{10}KA$ at the time when a current of 10 KA was allowed to flow through each sample, and a discharge voltage ratio $V_{10KA}/V_{1mA}$ was evaluated therefrom. This discharge voltage ratio means that the less it is, the better a non-linearity of the sample is. Further, the capability of energy dissipation is represented with a rectangular wave discharge bearing capacity (Joul) per unit volume ($cm^3$) of the sample at the time when a current rectangular wave of 2 m sec is applied thereto, in accordance with the procedure described on page 43 of JEC-203 (Standard of the Japanese Electrochemical Committee). The obtained results are set forth in Table 3 below.

TABLE 3

| Sample number | $\frac{V_{1KA}}{V_{1mA}}$ | Capability of Energy Dissipation ($J/cm^3$) |
|---|---|---|
| 1 | 1.88 | 240 |
| 2 | 1.89 | 250 |
| 3 | 1.87 | 250 |
| 4 | 1.85 | 260 |
| 5 | 1.88 | 240 |
| 6 | 1.90 | 250 |
| 7 | 1.88 | 250 |
| 8 | 1.84 | 260 |

TABLE 3-continued

| Sample number | $\frac{V_{1KA}}{V_{1mA}}$ | Capability of Energy Dissipation ($J/cm^3$) |
|---|---|---|
| 9 | 1.95 | 240 |
| 10 | 1.90 | 250 |
| 11 | 1.90 | 250 |
| 12 | 1.87 | 260 |
| 13 | 1.89 | 250 |
| 14 | 1.88 | 240 |
| 15 | 1.87 | 250 |
| 16 | 1.86 | 250 |
| 17 | 1.96 | 240 |
| 18 | 1.86 | 240 |
| 19 | 1.89 | 250 |
| 20 | 1.90 | 240 |
| 21 | 1.91 | 240 |
| 22 | 1.88 | 240 |
| 23 | 1.94 | 240 |
| 24 | 1.88 | 250 |
| 25 | 1.90 | 250 |
| 26 | 1.91 | 250 |
| 27 | 1.86 | 260 |
| 28 | 1.91 | 250 |
| 29 | 1.96 | 230 |
| 30 | 1.93 | 240 |
| 31 | 1.92 | 240 |
| 32 | 1.93 | 240 |
| 33 | 1.91 | 250 |
| 34 | 1.92 | 240 |
| 35 | 1.93 | 240 |
| 36 | 1.92 | 240 |
| 37 | 1.90 | 250 |
| 1′ | 1.98 | 200 |
| 2′ | 1.97 | 210 |
| 3′ | 2.01 | 200 |
| 4′ | 1.97 | 200 |
| 5′ | 1.98 | 210 |
| 6′ | 1.99 | 210 |
| 7′ | 2.00 | 200 |
| 8′ | 1.98 | 210 |
| 9′ | 2.01 | 210 |
| 10′ | 1.98 | 210 |
| 11′ | 1.98 | 200 |
| 12′ | 1.99 | 200 |
| 13′ | 2.00 | 210 |
| 14′ | 1.98 | 200 |
| 15′ | 2.00 | 200 |
| 16′ | 1.99 | 200 |
| 17′ | 2.02 | 190 |
| 18′ | 2.01 | 190 |

(3) Quality stability of products

With regard to Sample 1, 10 lots at 10 products per lot were manufactured, and $V_{1mA}$ was measured on all the products to determine their variability. The obtained results are exhibited in FIG. 1. For comparison, with regard to Sample 15′, a similar procedure was carried out to determine variability for each lot, and the obtained results are exhibited in FIG. 2.

As clearly seen from FIGS. 1 and 2, the samples according to this invention are extremely small in the scatter as compared with comparative samples.

As the above-mentioned results show, the zinc oxide varistor according to this invention is excellent in non-linearity (varistor characteristics), is great in capability of energy dissipation, is good in life performances, displays little variability between lots and within each lot at the time of manufacture, and is thus excellent in a quality stability. Further, the manufacturing process in this invention requires no grinding step, and an inclusion of impurities can accordingly be prevented completely. Furthermore, it should be noted that the varistor according to this invention can be obtained with a uniform structure.

We claim:

1. A metal oxide varistor comprising a component of grain bodies comprised of zinc oxide and a component of grain boundary layers comprised of at least one metallic oxide containing metal other than zinc, wherein at least a portion of at least one of said zinc oxide and said metallic oxide comprises a fine particle powder prepared by a co-precipitation method consisting essentially of the steps of (a) preparing an aqueous solution comprising at least two metal ions;

(b) by adding a base, forming a co-precipitate comprising substantially all of said metal ions in the form of corresponding metallic oxides; and thereafter (c) carrying out refrigerating dehydration of said co-precipitate.

2. A metal oxide varistor according to claim 1, wherein said metal ion in said first aqueous solution comprises at least one selected from the group consisting of antimony, bismuth, cobalt, manganese, nickel, chromium and silicon.

3. A metal oxide varistor according to claim 1, wherein said fine particle powder prepared by said co-precipitation method comprises between about 0.4 to about 100% by weight of all metallic oxides comprising said metal varistor.

4. A metal oxide varistor according to claim 1, wherein at least a portion of both of said zinc oxide and said metallic oxide comprises a fine particle powder prepared by said co-precipitation method comprising the steps of (a) preparing (i) a first aqueous solution comprising at least one metallic salt containing a metal ion other than zinc and (ii) a third aqueous solution comprising a metallic salt containing zinc ion;

($b_1$) forming a second aqueous solution by homogeneously mixing said first and third aqueous solution; and ($b_2$) adding said base to said second solution in sufficient amounts to form a co-precipitate from said second solution, said co-precipitate comprising substantially all of said zinc ion and said metal ion other than zinc.

5. A metal oxide varistor as in claim 4, wherein said metal ion other than zinc comprises at least one selected from the group consisting of antimony, bismuth, cobalt, manganese, nickel, chromium, and silicon.

6. A metal oxide varistor according to claim 1, wherein said refrigerating dehydration is carried out at a temperature of about −25° C. or less.

7. A process for manufacturing a metal oxide varistor, consisting essentially of the steps of (a) preparing an aqueous solution comprising at least two ions;

(b) by adding a base, forming a co-precipitate comprising substantially all of said metal ions in the form of corresponding metallic oxides; then (c) carrying out refrigerating dehydration of said co-precipitate; and (d) molding said co-precipitate under pressure to form a compact body.

8. A process according to claim 7, comprising the steps of (a) preparing (i) a first aqueous solution comprising at least one metallic salt containing a metal ion other than zinc and (ii) a third aqueous solution comprising a metallic salt containing zinc ion;

($b_1$) forming said second aqueous solution by homogeneously mixing said first and third aqueous solutions;

($b_2$) adding said base to said second solution in sufficient amounts to form a co-precipitate from said second solution, said precipitate comprising substantially all of said zinc ion and said metal ion other than zinc; and (c) molding said co-precipitate under pressure to form a compact body.

9. A process according to claim 7 wherein said refrigerating dehydration is carried out at a temperature of about −25° C. or less.

10. A fine particle powder consisting essentially of metallic oxides, formed by a co-precipitation method consisting essentially of the steps of (a) preparing an aqueous solution comprising at least two metal ions;

(b) by adding a base, forming a co-precipitate comprising substantially all of said metal ions in the form of corresponding metallic oxide; and then (c) carrying out refrigerating dehydration of said co-precipitate, said co-precipitate being adapted for manufacturing metallic oxide varistors therefrom.

11. A fine particle powder as in claim 10, wherein said co-precipitation method comprises the steps of (a) preparing (i) a first aqueous solution comprising at least one metallic salt containing a metal ion other than zinc and (ii) a third aqueous solution comprising a metallic salt containing zinc ion;

($b_1$) forming a second aqueous solution by homogeneously mixing said first and third aqueous solutions; and ($b_2$) adding said base to said second solution in sufficient amounts to form a co-precipitate from said second solution, said co-precipitate comprising substantially all of said zinc ion and said metal ion other than zinc.

12. A fine particle powder according to claim 10, wherein said refrigerating dehydration is carried out at a temperature of about −25° C. or less.

* * * * *